US010736387B1

(12) United States Patent
Holt

(10) Patent No.: US 10,736,387 B1
(45) Date of Patent: Aug. 11, 2020

(54) BELLY BANGLE SYSTEM

(71) Applicant: Bradford Holt, Clearwater, FL (US)

(72) Inventor: Bradford Holt, Clearwater, FL (US)

( * ) Notice: Subject to any disclaimer, the term of this patent is extended or adjusted under 35 U.S.C. 154(b) by 0 days.

(21) Appl. No.: 16/125,173

(22) Filed: Sep. 7, 2018

(51) Int. Cl.
*A44C 15/00* (2006.01)
*A44C 25/00* (2006.01)

(52) U.S. Cl.
CPC ..... *A44C 15/0005* (2013.01); *A44C 15/0045* (2013.01); *A44C 15/0035* (2013.01); *A44C 25/00* (2013.01)

(58) Field of Classification Search
CPC . A44C 15/00; A44C 15/0035; A44C 15/0045; A44C 15/0005; A44C 7/002; A44C 5/0054; A44C 5/0092; A41F 9/00; A41F 9/002; A41F 11/02; A41F 11/16
USPC ..... D11/3, 4
See application file for complete search history.

(56) References Cited

U.S. PATENT DOCUMENTS 297,874 A * 4/1884 Thiery ..... A44C 5/0092 63/11
401,746 A * 4/1889 Johnstone ..... A44C 5/0092 63/1.12
4,781,036 A * 11/1988 Erickson ..... A44C 7/002 606/188
5,074,128 A * 12/1991 Kowalski ..... A44C 7/00 63/12
7,082,788 B1 * 8/2006 Mason ..... A44C 7/002 63/12
D820,141 S * 6/2018 Lara ..... D11/4
2002/0013598 A1 * 1/2002 Lasar ..... A44C 15/0035 606/188
2003/0046954 A1 * 3/2003 Ashton ..... A44C 15/0035 63/12
2004/0123625 A1 * 7/2004 Waldman ..... A44C 15/0035 63/12
2006/0090509 A1 * 5/2006 Jones ..... A44C 7/00 63/12

OTHER PUBLICATIONS

"20+ Horizontal Navel Piercing Pictures", Askldeas.com, Aug. 2, 2016. (Year: 2016).*

* cited by examiner

*Primary Examiner* — Emily M Morgan

(57) ABSTRACT

A central component is positionable in a generally horizontal plane around a waist of the wearer. The central component is formed as an arc of a circle. The central component has an end with male screw threads. A peripheral component is positionable in a generally vertical plane adjacent to the waist of the wearer when worn. The peripheral component has an inner end with inner male screw threads and an outer end. A coupling ball has a diametric aperture formed with ends with female screw threads receiving the end of the central component and the inner end of the peripheral component.

1 Claim, 2 Drawing Sheets

FIG. 1
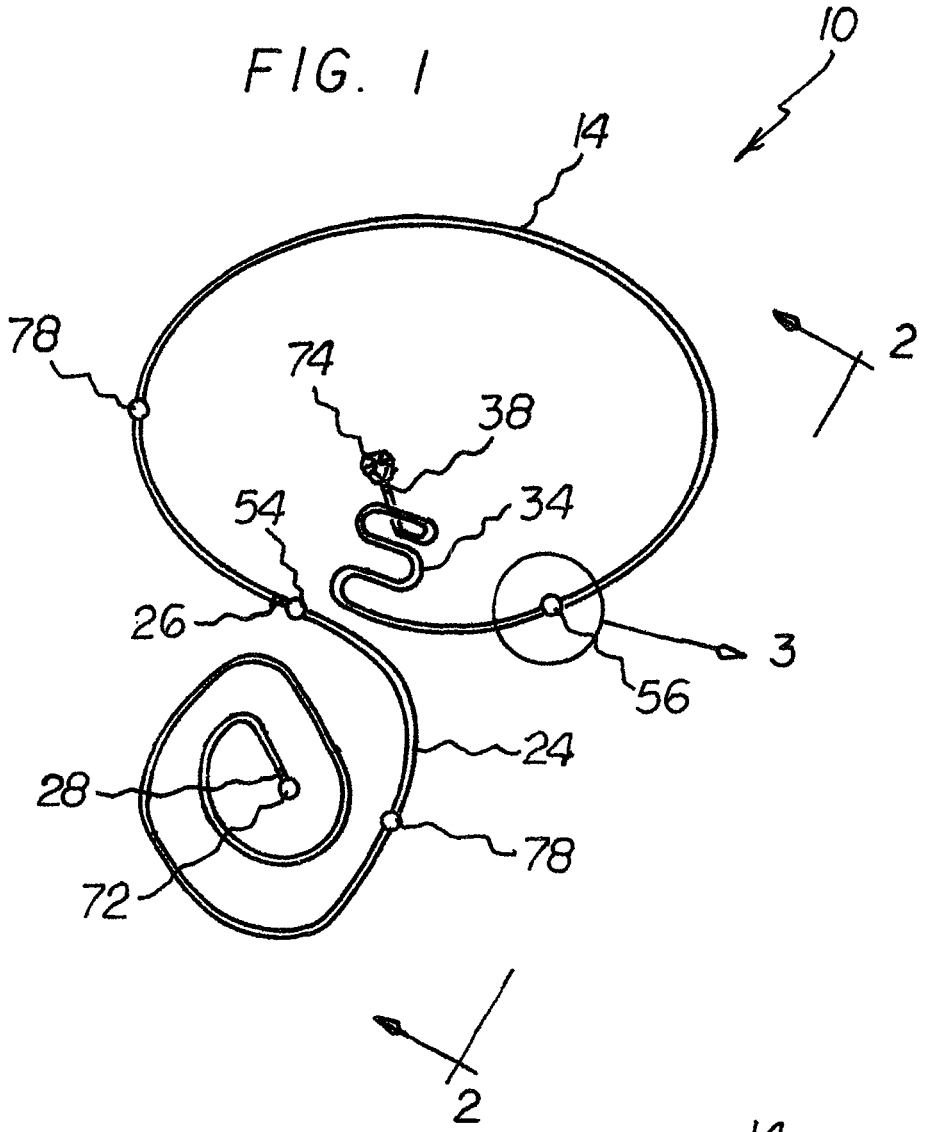
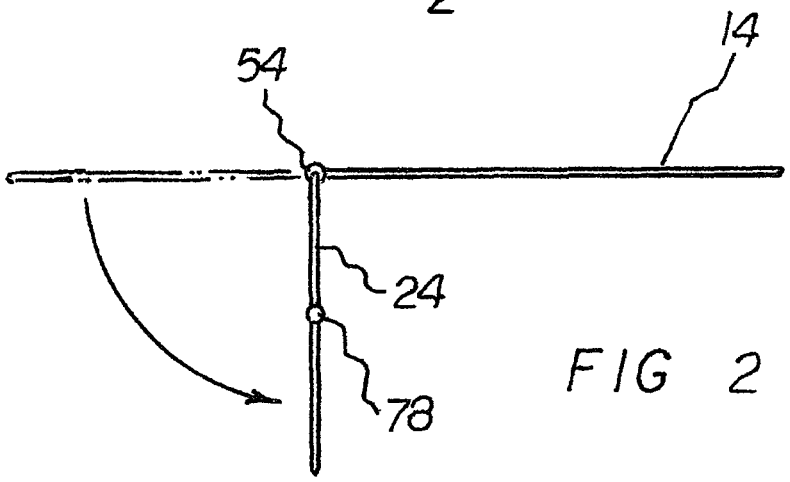
FIG 2

FIG. 3
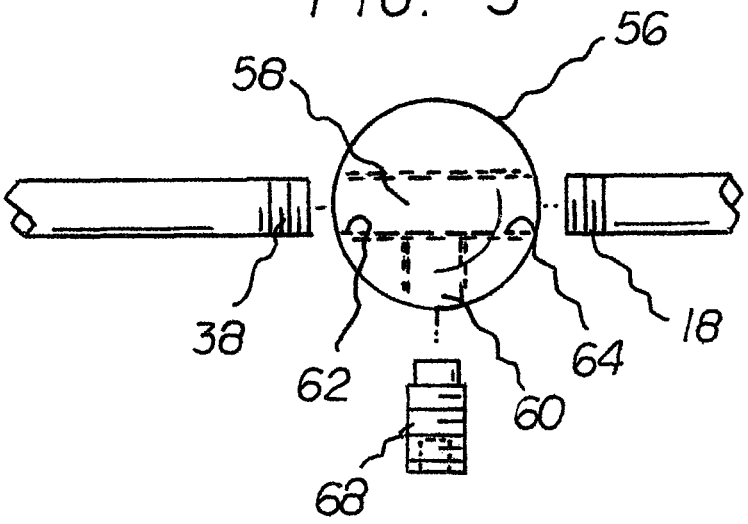
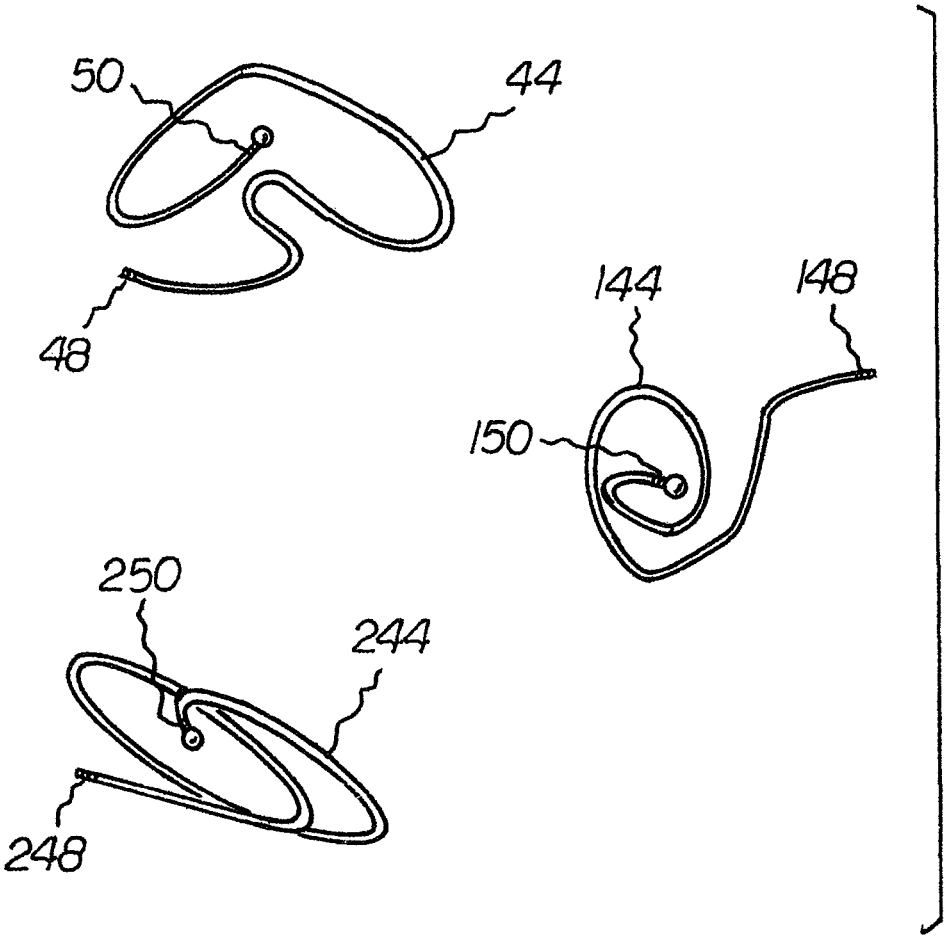
FIG. 4

BELLY BANGLE SYSTEM

BACKGROUND OF THE INVENTION

Field of the Invention

The present invention relates to a belly bangle system and more particularly pertains to adorning a body of a wearer and for varying an appearance of the wearer through an interchange of various optional components of the system.

Description of the Prior Art

The use of decorative apparel is known in the prior art. More specifically, decorative apparel, previously devised and utilized for the purpose of enhancing the appearance of a wearer are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a belly bangle system that allows adorning a body of a wearer and for varying an appearance of the wearer through an interchange of various optional components of the system.

In this respect, the belly bangle system according to the present invention substantially departs from the conventional concepts and designs of the prior art, and in doing so provides an apparatus primarily developed for the purpose of adorning a body of a wearer and for varying an appearance of the wearer through an interchange of various optional components of the system.

Therefore, it can be appreciated that there exists a continuing need for a new and improved belly bangle system which can be used for adorning a body of a wearer and for varying an appearance of the wearer through an interchange of various optional components of the system. In this regard, the present invention substantially fulfills this need.

SUMMARY OF THE INVENTION

In view of the disadvantages inherent in the known types of decorative apparel now present in the prior art, the present invention provides an improved belly bangle system. As such, the general purpose of the present invention, which will be described subsequently in greater detail, is to provide a new and improved belly bangle system and method which has all the advantages of the prior art and none of the disadvantages.

To attain this, from a broad perspective, the present invention essentially comprises a central component positionable in a generally horizontal plane around a waist of the wearer. The central component is formed as an arc of a circle. The central component has an end with male screw threads. A peripheral component is positionable in a generally vertical plane adjacent to the waist of the wearer when worn. The peripheral component has an inner end with inner male screw threads and an outer end. A coupling ball has a diametric aperture formed with ends with female screw threads receiving the end of the central component and the inner end of the peripheral component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved belly bangle system which has all of the advantages of the prior art decorative apparel and none of the disadvantages.

It is another object of the present invention to provide a new and improved belly bangle system which may be easily and efficiently manufactured and marketed.

It is a further object of the present invention to provide a new and improved belly bangle system which is of durable and reliable constructions.

An even further object of the present invention is to provide a new and improved belly bangle system which is susceptible of a low cost of manufacture with regard to both materials and labor, and which accordingly is then susceptible of low prices of sale to the consuming public, thereby making such belly bangle system economically available to the buying public.

Lastly, it is an object of the present invention to provide a belly bangle system for adorning a body of a wearer and for varying an appearance of the wearer through an interchange of various optional components of the system.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a belly bangle system constructed in accordance with the principles of the present invention, the system being shown in a planar configuration prior to wearing.

FIG. 2 is a side elevational view taken along line 2-2 of FIG. 1 but with the system in a partially deployed orientation.

FIG. 3 is an enlarged illustration of a portion of the system taken at circle 3 of FIG. 1.

FIG. 4 is a plan view of a plurality of optional components for use with the central component of FIGS. 1 and 2.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved belly bangle system embodying the principles and concepts of the present invention and generally designated by the reference numeral 10 will be described.

The present invention, the belly bangle system 10 is comprised of a plurality of components. Such components in their broadest context include a central component and a peripheral component and a coupling ball. Such components are individually configured and correlated with respect to each other so as to attain the desired objective.

From a specific perspective, the invention of the present application is a belly bangle system 10 for adorning a body of a wearer and for varying an appearance of the wearer through an interchange of various optional components of the system. The adorning and the varying are done in a safe, eye-appealing, convenient, and economical manner. The system comprises, in combination, a central component 14 positionable in a generally horizontal plane around a waist of the wearer. The central component is formed as an arc of a circle. The arc extending from 270 degrees to 315 degrees. The central component has a length of from 18 inches to 26 inches. The central component has a first end with first male screw threads 16 and a second end with second male screw threads 18.

A first peripheral component 24 has a generally spiral configuration positionable in a generally vertical plane adjacent to the waist of the wearer when worn. The first peripheral component has an inner end with first inner male screw threads 26 and an outer end with first outer male screw threads 28.

A second peripheral component 34 has a generally serpentine configuration positionable in a generally vertical plane adjacent to the waist of the wearer when worn. The second peripheral component has an inner end with second inner male screw threads 36 and an outer end with second outer male screw threads 38.

A plurality of optional peripheral component include random curves 44, and an irregular spiral 144, and loops 244. All of the optional peripheral components are positionable in a generally vertical plane adjacent to the waist of the wearer when worn. Each of the plurality of optional peripheral components has an inner end with optional peripheral inner male screw threads 48, 148, 248 and an outer end with optional peripheral outer male screw threads 50, 150, 250.

The central component and the first and second peripheral components and the plurality of optional peripheral components all have a circular cross sectional configuration with a diameter of 0.0625 inches, plus or minus 20 percent. The central component and the first and second peripheral components and the plurality of optional components are all fabricated of spring steel with silver plating.

A first coupling ball 54 and a second coupling ball 56 are next provided. The first and second coupling balls each have a diametric aperture 58 and a threaded radial aperture 60. Each diametric aperture has ends with female screw threads 62, 64 receiving an end of the central component and an inner end of a peripheral component respectively. A set screw 68 is threadedly received in the radial aperture to hold together an end of the central component and an inner end of a peripheral component.

Two end caps 72, 74 are threadedly received on the outer ends of the peripheral components respectively. The two end caps each have a decorative shape including a spherical shape and a diamond shape.

Lastly provided, a plurality of slide balls 78 are slidably received on the central component and on at least one peripheral and optional peripheral components.

The coupling balls and the end caps and the slide balls are preferably fabricated of brass.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A belly bangle system (10) for adorning a body of a wearer and for varying an appearance of the wearer through an interchange of various optional components of the system, the system comprising, in combination:

a central component (14) positioned in a generally horizontal plane around a waist of the wearer, the central component being formed as an arc of a circle, the arc extending from 270 degrees to 315 degrees, the central component having a length of from 18 inches to 26 inches, the central component having a first end with first male screw threads (16) and a second end with second male screw threads (18);

a first peripheral component (24) having a generally spiral configuration positioned in a generally vertical plane adjacent to the waist of the wearer when worn, the first peripheral component having an inner end with first inner male screw threads (26) and an outer end with first outer male screw threads (28);

a second peripheral component (34) having a generally serpentine configuration positioned in a generally vertical plane adjacent to the waist of the wearer when worn, the second peripheral component having an inner end with second inner male screw threads (36) and an outer end with second outer male screw threads (38);

a plurality of optional peripheral component including random curves (44), and an irregular spiral (144), and loops (244), all of the optional peripheral components positioned in a generally vertical plane adjacent to the waist of the wearer when worn, the plurality of optional peripheral component each having an inner end with optional peripheral inner male screw threads (48)(148)(248) and an outer end with optional peripheral outer male screw threads (50)(150)(250);

the central component and the first and second peripheral components and the plurality of optional peripheral components all having a circular cross sectional configuration with a diameter of 0.0625 inches, plus or minus 20 percent, the central component and the first and second peripheral components and the plurality of optional components all being fabricated of spring steel with silver plating;

a first coupling ball (54) and a second coupling ball (56), the first and second coupling balls each having a diametric aperture (58) and a threaded radial aperture (60), each diametric aperture having ends with female screw threads (62)(64) receiving an end of the central component and an inner end of a peripheral component respectively, a set screw (68) threadedly received in the radial aperture to hold together an end of the central component and an inner end of a peripheral component;

two end caps (72)(74) threadedly received on the outer ends of the peripheral components respectively, the two end caps each having a decorative shape including a spherical shape and a diamond shape; and a plurality of slide balls (78) slidably received on the central component and on at least one peripheral and optional peripheral components;

the coupling balls and the end caps and the slide balls being fabricated of brass.

* * * * *